US007784556B2

(12) United States Patent
Richardson et al.

(10) Patent No.: US 7,784,556 B2
(45) **Date of Patent: *Aug. 31, 2010**

(54) SYSTEM AND METHOD FOR SUPPRESSING FIRES

(75) Inventors: Adam Tartar Richardson, Toronto (CA); Joseph Michael Bennett, Huber Heights, OH (US)

(73) Assignee: N2 Towers, Inc. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/256,841

(22) Filed: Oct. 23, 2008

(65) Prior Publication Data

US 2009/0038812 A1 Feb. 12, 2009

Related U.S. Application Data

(63) Continuation of application No. 10/672,169, filed on Sep. 26, 2003, now Pat. No. 7,455,120, which is a continuation-in-part of application No. 10/286,590, filed on Nov. 1, 2002, now Pat. No. 7,028,782.

(60) Provisional application No. 60/414,157, filed on Sep. 28, 2002.

(51) Int. Cl.
*A62C 2/00* (2006.01)

(52) U.S. Cl. ..... 169/46; 169/6; 169/12; 169/26; 169/28; 169/71

(58) Field of Classification Search ..... 169/12, 169/35, 58, 62, 84, 28; 280/740, 741; 149/36, 149/62, 76

See application file for complete search history.

(56) References Cited

U.S. PATENT DOCUMENTS 5,423,384 A * 6/1995 Galbraith et al. ..... 169/12
6,024,889 A * 2/2000 Holland et al. ..... 252/5
6,116,348 A * 9/2000 Drakin ..... 169/46
6,136,114 A 10/2000 Johnson et al.
7,028,782 B2 * 4/2006 Richardson ..... 169/28
7,455,120 B2 * 11/2008 Richardson et al. ..... 169/46

FOREIGN PATENT DOCUMENTS

DE 19546528 A1 6/1997
DE 19717044 A1 10/1997

(Continued)

OTHER PUBLICATIONS

"Pyrogen Simply Better Than Halon" Announcement Pyrogen, XX, XX, 1998, page COMPLETE05 XPOO0669776.

(Continued)

*Primary Examiner*—Dinh Q Nguyen
(74) *Attorney, Agent, or Firm*—Katten Muchin Rosenman LLP

(57) ABSTRACT

A method and apparatus for suppressing in a space includes structure and/or function for generating a first oxygen displacing fire suppressing gas mixture from at least one non-azide solid propellant chemical, the first fire suppressing gas mixture having at least a first gas. The first gas comprises nitrogen. At least the first gas is delivered into the space, thereby delivering a clean agent fire suppressant into the space that reduces the concentration of oxygen in the space to below a level necessary to sustain combustion. Preferably, the method and apparatus are used in inhabited spaces.

19 Claims, 3 Drawing Sheets

FOREIGN PATENT DOCUMENTS

| | | | |
|---|---|---|---|
| JP | 05-084318 | A | 4/1993 |
| JP | 09-192252 | A | 7/1997 |
| WO | 93/15793 | A1 | 8/1993 |
| WO | 03/024534 | A1 | 3/2003 |

OTHER PUBLICATIONS

"Pyrogen Simply Better Than Halon" Announcement Pyrogen, XX, XX, 1998, page COMPLETE05 XP000669776.

Fletcher M: "Fighting Fire With Fire" Eureka (Inc. Engineering Materials and Design), Findlay Publications, Horton Kirby, Kent, GB, vol. 20, No. 1, Jan. 2000, p. 17 XP000877927 ISSN: 0261-2097.

Jun. 8, 2009 Communication from the European Patent Office regarding European Patent Application No. 03753190.2.

* cited by examiner

SYSTEM AND METHOD FOR SUPPRESSING FIRES

This application is a continuation of U.S. patent application Ser. No. 10/672,169, filed Sep. 26, 2003, now U.S. Pat. No. 7,455,120, issued Nov. 25, 2008, which is a continuation-in-part of U.S. patent application Ser. No. 10/286,590, filed Nov. 1, 2002 (now U.S. Pat. No. 7,028,782, issued Apr. 18, 2006), which claims priority to U.S. Provisional Patent Application No. 60/414,157, filed Sep. 28, 2002, the contents of each of which are incorporated herein by reference.

BACKGROUND OF THE INVENTION

1. Field of the Invention

The present invention is directed to a system and method for suppressing fires in normally occupied areas utilizing non-azide solid propellant inert gas generators. In one aspect, this invention relates to the use of solid propellant inert gas generators for suppressing fires in occupied spaces whereby human life can still be supported in those spaces for a period of time.

2. Description of the Related Art

Numerous systems and methods for extinguishing fires in a building have been developed, Historically, the most common method of fire suppression has been the use of sprinkler systems to spray water into a building for cooling the fire and wetting additional fuel that the fire requires to propagate. One problem with this approach is the damage that is caused by the water to the contents of the occupied space.

Another method is the dispersal of gases, such as nitrogen, to displace oxygen in an enclosed space and thereby terminate a fire while still rendering the enclosed space safe for human occupancy for a period of time. For example, U.S. Pat. No. 4,601,344, issued to The Secretary of the Navy, discloses a method of using a glycidyl azide polymer composition and a high nitrogen solid additive to generate nitrogen gas for use in suppressing fires. The problem with the method disclosed in U.S. Pat. No. 4,601,344 is that azide compositions are used, which potentially may be harmful to human health and which typically generate less gas by weight relative to non-azide compositions.

Yet another method is the dispersal of gases, such as Halon 1301, to chemically suppress a fire. These systems store the Halon 1301 gas in a liquid state under pressure in compressed gas cylinders. Typically, a plurality of such cylinders is required for a single small building. The use and maintenance of compressed gas cylinders is expensive. Further, they are often stored in a separate location in the building, thereby detracting from the usable floor space in a building.

Due to their use of ozone depleting greenhouse gases, Halon 1301 systems are being replaced by more environmentally friendly alternative systems, as mandated by the 1987 Montreal and 1991 Kyoto International Protocols. One example of a Halon 1301 alternative system uses HFC (e.g. FM-200 Fire Suppression System manufactured by Kidde Fire Systems), while others use an inert gas mixture (e.g. Inergen Fire Suppression System manufactured by Ansul Incorporated, or the system set forth in U.S. Pat. No. 4,807,706 issued to Air Products and Chemicals Inc.).

One disadvantage of such Halon 1301 alternate systems, is that they require substantially more fire suppression agent/gas on a lb per lb ratio than Halon 1301 (and therefore even more compressed gas cylinders) to produce the same performance. These new Halon 1301 alternative systems also require the use of high pressure piping and nozzle delivery systems to transport the agent to the protected area. This increases the cost of the system.

The existing ubiquitous Halon 1301 systems are used in North America for asset protection in high risk areas, such as electrical transformer vaults, airport control towers, computer rooms, telephone switch gear enclosures, etc., which operate 24 hours per day. In order to install a Halon 1301 alternative system which, as indicated above, uses discharge piping and nozzles, requires the end user of these systems to shut down the equipment (i.e. assets) being protected in order to install the alternative system. Such shut down procedures can be expensive.

U.S. Pat. Nos. 6,016,874 and 6,257,341 (Bennett) disclose the use of a dischargeable container having self-contained therein an inert gas composition. A discharge valve controls the flow of the gas composition from the closed container into a conduit. A solid propellant is ignited by an electric squib and burns thereby generating nitrogen gas. The propellant is said to be a mixture of sodium azide and sulphur which, as indicated above, can be harmful to human health.

Non-azide solid propellants are known in the art for inflating air bags and actuating seatbelt pretensioners in passenger-restraint devices, such as described in U.S. Pat. Nos. 5,520,826 (Reed Jr. et al) and 6,287,400 (Bums et al). However, there is no discussion in the art of using non-azide compositions in a system, which does not contain any compressed gas containers and piping, for extinguishing fires in normally occupied spaces.

SUMMARY OF THE INVENTION

It is an aspect of the present invention to provide a system and method for suppressing fires, which does not require the use of compressed gas cylinders, piping and nozzle delivery systems. According to one aspect of the invention, at least one non-azide solid gas propellant is used to generate gases to extinguish a fire. As discussed in greater detail below, the solid gas propellant is housed within a tower system that requires no piping, thereby resulting in minimal "down time" of the customer's assets (i.e. equipment) being protected, during replacement of existing Halon 1301 systems. Minimal down time during the replacement of existing Halon 1301 systems means substantial cost savings to the owner of these systems. Also, the towers of the present invention do not have to be removed from the location they are protecting in order to be recharged. Rather, the inventive system may be recharged on site through the use of pre-packed non-azide propellant generators. The system is preferably operated to permit human life to be maintained for a period of time (e.g. by maintaining a sufficient mix of gases in the building to permit human habitation for a period of time while still being useful for suppressing fires).

According to an alternative embodiment of the invention, the gas generator units are suspended from the ceiling, or actually mounted on the ceiling or suspended above a drop ceiling. Such mounting locations can be selected to not impede personnel operations or occupation of usable space within the room. Protection units may be a single unit sized for the compartment volume to be protected, or an assemblage of smaller individual cartridges mounted within a fixture, with sufficient cartridges added to protect a given protected volume.

One advantage of the instant invention is that, due to the use of non-azide solid propellant gas generators to suppress a fire, instead of compressed gas cylinders and a piping discharge system, the cost of installation of the system is dramatically reduced. A further advantage is that, without the use of compressed gas cylinders, the solid gas generators need not be stored in one location and connected to a distribution piping system extending throughout a building.

Instead, the fire suppression system may comprise a plurality of independent assemblies, each of which comprises at least one solid gas generator positioned in the enclosure where the gas will be required to extinguish a fire. Thus a fire suppression system for a building may be constructed without installing a piping system extending throughout an entire building.

In accordance with the instant invention, there is provided a method of suppressing fires in a space comprising the steps of generating a first suppressing gas mixture from at least one solid chemical non-azide propellant, the first suppressing gas mixture comprising at least a first gas (100% nitrogen), may include a second gas (100% water vapor), and/or third gas (100% carbon dioxide): filtering at least a percentage of the second and or third gas from the first fire suppressing gas mixture to produce a second fire suppressing gas mixture; and delivering the second fire suppressing gas mixture into the area which is to be protected.

In one embodiment, the first gas is 100% nitrogen. In another embodiment, the second gas will comprise 100% water vapor. In another embodiment the third gas is 100% $CO_2$.

In another embodiment, substantially all of the second gas and/or third gas is filtered from the first fire suppressing gas mixture prior to the delivery of the fire suppressing gas mixture into the space (area).

The suppressing gas mixture permits the space to be habitable by human life for a predetermined time. Preferably, the predetermined time ranges from about one to five minutes, as per the requirements of the National Fire Prevention Association's 2001 standard for clean agent Halon 1301 alternatives.

In accordance with the instant invention, there is also provided an apparatus for suppressing fires in a normally occupied area. The apparatus comprises a sensor for detecting a fire; at least one solid pre-packed non-azide propellant gas generator for generating a fire suppression gas upon receiving a signal from the sensor, and a diffuser to direct the fire suppression gas into the enclosure. The concentration of gas in the normally occupied area after delivery/generation of the fire suppression gas permits the normally occupied area to be habitable by human life for a predetermined time.

In one embodiment, the suppressing gas comprises at least two and/or three gases and the apparatus further comprises at least one filter and screen for filtering a portion of two of the gases from the fire suppression gas and reducing the heat of the gas generated prior to the delivery of the fire suppressing gas to the normally occupied area. The filter(s) may be adapted to filter substantially all of the second and/or third gases from the fire suppressing gas mixture.

These together with other aspects and advantages which will be subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

According to the present invention, a pre-packed solid gas generator is used for generating a gas mixture that is suitable for suppressing a fire from a solid non-azide chemical. Preferably, the solid chemical (not shown) used in the solid gas generator(s) may be similar to those used as gas generators for automobile air bags. The solid chemical does not contain azides. Azide compositions can be regarded as harmful to human health, and furthermore, often generate less gas by weight relative to non-azide compositions. Newer generation automotive air bags for cars utilize such non-azide systems and any of these may be used in solid gas generators.

In operation, solid gas generators produce an inert or near inert gas such as nitrogen, which reduces the concentration of oxygen in a room below the level that will sustain combustion. However, the oxygen concentration is maintained at a sufficient level to meet the requirements of the National Fire Prevention Association's 2001 standard for clean agent Halon 1301 alternatives in normally occupied areas. The person having ordinary skill in this art knows that the National Fire Protection Association's 2001 standard (published by the NFPA entitled NFPA 2001 Standard on Clean Agent Fire Extinguishing Systems ("NFPA 2001"), cited in an Information Disclosure Statement filed concurrently herewith) states in Section 1-1 of the document:

> 1-1 Scope. This standard contains minimum requirements for total flooding and local application clean agent fire extinguishing systems. It does not cover fire extinguishing systems that use carbon dioxide or water as the primary extinguishing media, which are addressed by other NFPA documents.

According to Subsection 1-5.1.1 of the NFPA 2001 document:

> 1-5.1.1 The fire extinguishing agents addressed in this standard shall be electrically nonconducting and leave no residue upon evaporation.

Furthermore, the definition of clean agent is specified in Section 1-3.8 of the NFPA 2001 document as follows:

> 1-3.8 Clean Agent. Electrically nonconducting, volatile, or gaseous fire extinguishant that does not leave a residue upon evaporation. The word agent as used in this document means clean agent unless otherwise indicated.

Figure 1A:
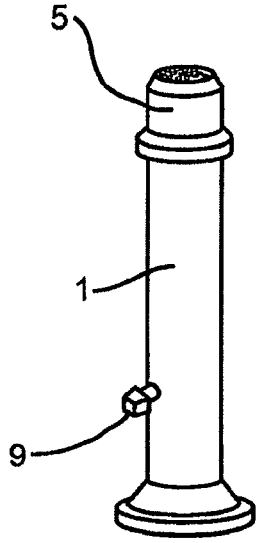
FIG. 1A shows an assembled gas generator fire suppression tower according to the preferred embodiment.
Figure 1B:
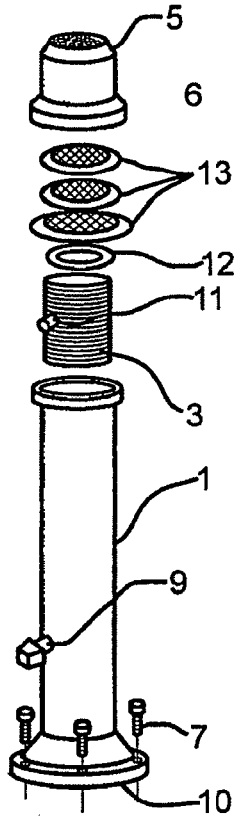
FIG. 1B is an exploded view of the fire suppression tower of FIG. 1A.

As shown in FIGS. 1A and 1B, a gas generator fire suppression tower 1 is provided containing a pre-packed non-azide solid propellant canister 3 and a discharge diffuser 5 for discharging generated gases. The tower 1 is secured in position by floor mounting bolts 7 passing through a mounting flange 10, or any other suitable means. The diffuser 5 is likewise secured to the tower 1 using flange bolts with nuts 6.

A pyrotechnic device 9 (i.e. a squib) is attached to the pre-packed canister 3 by way of a connector 11, and to a fire detection and release control panel discussed in greater detail with reference to FIGS. 2A and 3. The squib is used to initiate the inert gas generation in response to electrical activation.

A propellant retainer 12 is provided along with various optional filters and/or screens 13, as discussed in greater detail below.

Figure 2A:
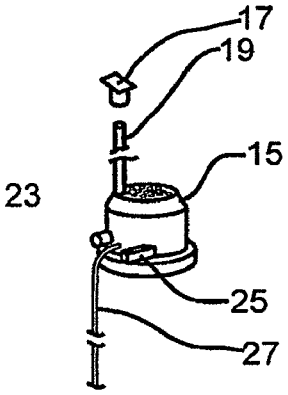
FIG. 2A shows electrical connections to a diffuser cap of the tower in FIGS. 1A and 1B.
Figure 3:
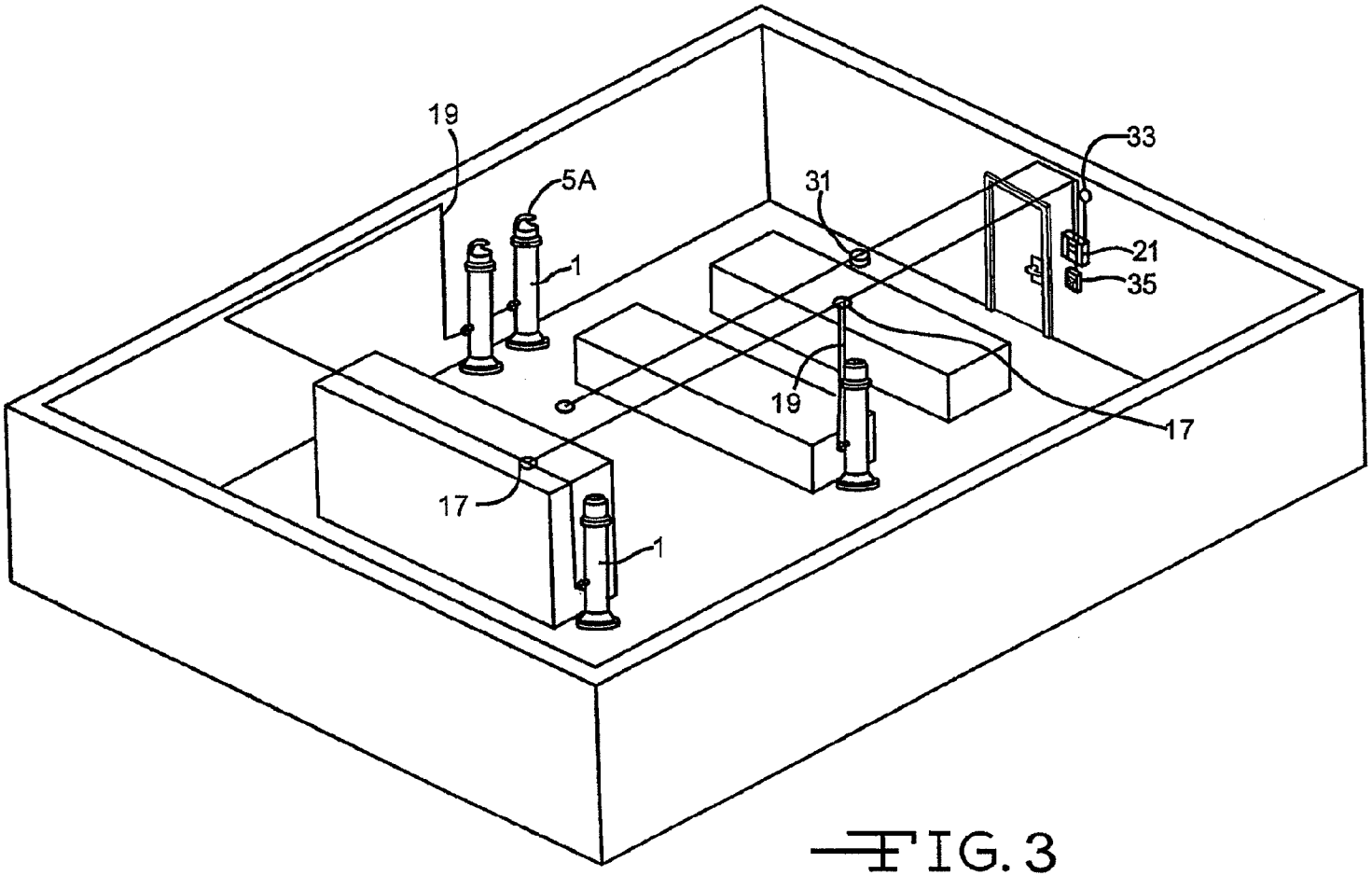
FIG. 3 is a schematic view of an enclosed space protected using the gas generator fire suppression towers of the present invention.

Turning to FIG. 2A in combination with FIG. 3, the discharge diffuser 5 is shown having a perforated cap 15. A raceway ceiling mounting foot 17 is provided for securing a conduit/wiring raceway 19 (e.g. steel pipe) between the fire detection and release panel 21 (FIG. 3) and a conduit connection 23 on a bracket 25. The conduit continues downwardly to the squib 9, as shown at 27.

Figure 2B:
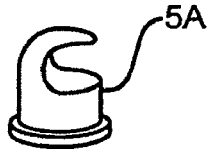
FIGS. 2B-2D show alternative embodiments of diffuser caps for use with the gas generator fire suppression tower of FIGS. 1A and 1B.
Figure 2C:
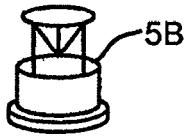
Figure 2D:
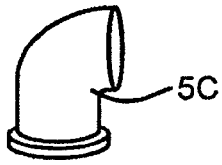

FIGS. 2B-2D show alternative embodiments of discharge diffusers 5, for different installations of the tower 1, which may serve either as replacements for the perforated cap diffuser or be placed thereover. More particularly, FIG. 2B depicts a 180 degrees directional diffuser cap 5A useful for installations wherein the tower is disposed along a wall. FIG. 2C depicts a 360 degrees directional diffuser cap 58 useful for installations wherein the tower is centrally disposed. FIG. 2D depicts a 90 degrees directional diffuser cap 5C useful for installations wherein the tower is disposed in a corner.

With reference to FIG. 3, a system is shown according to the present invention for suppressing fires in an enclosed space using a plurality of towers 1 as set forth in FIGS. 1 and 2. In operation, a sensor 31, upon detecting a fire, issues a signal to the control panel 21 which, in response, activates an alarm signaling device 33 (e.g. audible and/or visual alarm). Alternatively, an alarm may be initiated by activating a manual pull station 35. In response, the control panel 21 initiates a solid gas generator by igniting the pyrotechnic device 9, which in turn ignites the chemicals in the pre-packed canister 3 that produce the fire suppressing gas. The fire suppressing gas mixture preferably comprises nitrogen gas and may contain water vapor and/or carbon dioxide. However, as discussed above, the chemicals used in the solid gas generator do not contain azides.

As indicated above, the fire suppressing gas mixture may contain carbon dioxide and water vapor, which are optionally filtered using filters 13 (FIG. 1), resulting in the production of a filtered fire suppressing gas mixture. More particularly, the fire suppressing gas mixture may be filtered so that the gas introduced into the room (FIG. 3) contains from about zero to about five wt % carbon dioxide and preferably, from about zero to about three wt % carbon dioxide. More preferably, substantially all of the carbon dioxide in the mixture is filtered out of the mixture. The fire suppression gas mixture may also be filtered so that the gas introduced into the room will not form any substantial amount of liquid water when introduced into the environment of the fire. Preferably, the concentration of water vapor in the environment of the fire is maintained so that the water vapor is maintained above its dew point. Moreover, screens may be used to reduce the temperature of the fire suppressing gas generated as a result of igniting the pre-packed canister 3. Although the filters and screen(s) 13 are shown as being separate from the pre-packed canister 3, it is contemplated that at least the screen(s) may be incorporated as part of the canister structure.

Since there is no requirement to use compressed gas cylinders, discharge piping and discharge nozzles for the supply or transport of an extinguishing gas mixture, the system of FIG. 3 enjoys several advantages over the known prior art. Firstly, the use of only non-azide solid gas generators allows large amounts of gases to be generated with relatively low storage requirements. This reduces the cost of the system, making it more attractive to retrofit existing Halon 1301 systems with environmentally acceptable alternatives (i.e. inert or near-inert gasses are characterized as being zero ozone depleting and have zero or near-zero global warming potential).

Secondly, the system benefits from simplified installation and control since all of the solid gas generators need not be provided at one central location. Instead, one or more solid gas generators or towers 1 are preferably positioned at the location where the fire will have to be suppressed. In this way, the generation of fire suppressing gases within the hazard area, substantially simplifies the delivery of the gases without the need of a piping system extending throughout a building or perhaps through one or two walls.

Thirdly, the provision of independently positioned towers 1 results in the gas being generated and delivered to the hazard area almost instantaneously as it is released. This increases the response time of the fire suppressing system and its ability to inert the hazard area and suppress the fire in a normally occupied area. Each solid gas generator 1 is preferably designed to generate a quantity of gas needed to extinguish a fire in room, should the need arise.

The filtered fire suppressing gas mixture is delivered into the room (FIG. 3) containing a fire. The volume of filtered fire suppressing gas to be delivered into the room depends on the size of the room. Preferably, enough of the filtered fire suppressing gas mixture is delivered into the room to suppress any fire in the room, yet still permit the room to be habitable by human life for a predetermined time. More preferably, a volume of filtered fire suppressing gas mixture is delivered into the room that permits the room to be habitable by human life for approximately one to five minutes, and more preferably from three to five minutes, as per the requirements of the National Fire Prevention Association's 2001 standard for Halon 1301 clean agent alternatives in normally occupied areas.

Figure 4:
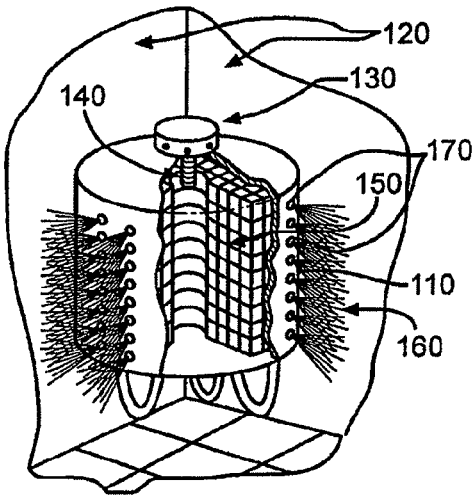
FIG. 4 is an illustration and partial cross section of a single gas generator unit mounted in a corner of a room to be protected, according to an alternative embodiment of the invention.

Referring now to the alternative embodiment of FIG. 4, an illustration and partial cross section is provided of a single gas generator unit mounted in a corner of a room to be protected. In this embodiment, the fire protection unit 110 is a floor mounted unit, in a room 120 to be protected from fire. The unit 110 is located in a space in the room that does not inhibit normal use of the room by occupants, or desired positioning of other equipment. An integral smoke or heat detector 130 is mounted on the unit 110 in this embodiment, although it can also be wired to normal ceiling-mounted smoke detectors. Upon detection of a fire or smoke by the detector 130, it sends an electrical signal to the propellant squib 140 that initiates the burning of the gas generator propellant 150, which generates the inert gas 160 in sufficient quantities to extinguish fires in an occupied compartment, discharged through the orifices or diffuser 171, in the exterior of the unit 110. Such a system, mounted directly into the room to be protected, eliminates the expense of distribution plumbing from a remote storage site, and the expense of its installation. In a variation of this alternative embodiment, the unit 110 can be suspended to hang from the ceiling, or mount directly on the wall, including the use of a wall bracket similar to those used to position televisions in hospital rooms.

Figure 5:
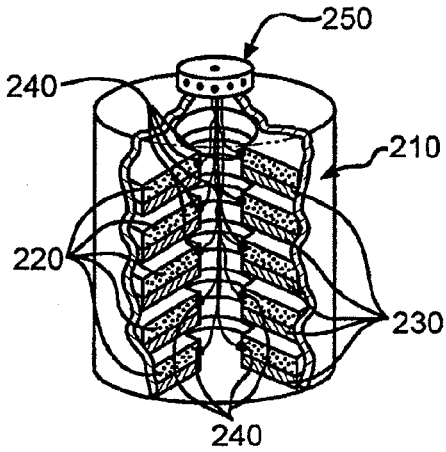
FIG. 5 is an illustration of a variation of the single gas generator room unit of FIG. 4, comprised of multiple gas generator cartridges.

FIG. 5 is an illustration of single gas generator room unit, comprised of multiple gas generator cartridges. In this variation to the system disclosed in FIG. 4, the unit 210 houses multiple individual gas generator units 220, each sized of a particular capacity to provide a sufficient quantity of inert gas for a given volume of occupied space. An internal rack 230 is a means of selectively installing a variable number of units 220, each with their own squib 240 and wired to the detector 250, to provide a precise quantity of inert gas necessary to protect a given volume of an occupied space to be protected. Although the unit 210 can be sized sufficiently to add a large number of such units to protect a very large space, for very large compartments, multiple units 210 spaced throughout the compartment, may be warranted to provide better mixing and inert gas coverage in the room.

Figure 6:
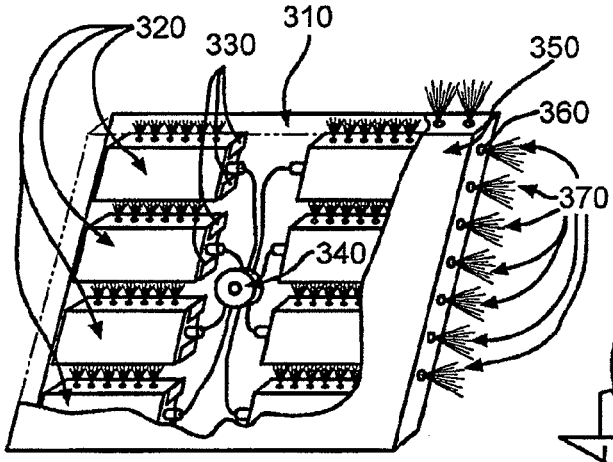
FIG. 6 is an illustration of a ceiling mounted fixture, holding multiple gas generator cartridges, according to a further alternative embodiment of the invention.

FIG. 6 is an illustration of a ceiling mounted fixture, holding multiple gas generator cartridges. A ceiling fixture 310 is mounted on the ceiling, extending a short distance below the ceiling height. Multiple gas generator units 320 can be mounted into the fixture at various bracket locations 330, much like the mounting brackets for individual fluorescent light bulbs. Like the system in FIG. 5, a varied number of units 320 can be added to the fixture 310 to vary the quantity of inert gas produced, and adjust for the room capacity to be protected. The fixture 310 can be sized to hold a certain maximum number of units 320, corresponding to a maximum room volume, or floor space for a given ceiling height, that can be protected with one fixture. Beyond this room volume, additional fixtures would be added, spaced evenly throughout the room. As an additional option, the traditional room smoke detector 340 can be mounted into the fixture 310, such as in its center, to activate the units 320 directly within the fixture 310. In this manner, the electrical power wires applied to the detector can also be used to fire the squibs of the units, rather than a remote routing of the power and detector lines, and the expense of routing an additional power line above the ceiling. The fixture 310 is covered with decorative dust cover 350 that hides the units and fixture with an attractive cover that blends into the ceiling motif, and features exhaust holes 360 around its perimeter functioning as a diffuser to direct the inert gas 370 discharged by the units into the room. Such a location and manner of discharge of the system promotes effective mixing with the room air and gives maximum distance for the hot inert gas to cool before coming into contact with occupants below. The location on the ceiling permits the system to require no floor space or room location for mounting, thereby not impeding any activities or usage of the room.

Figure 7:
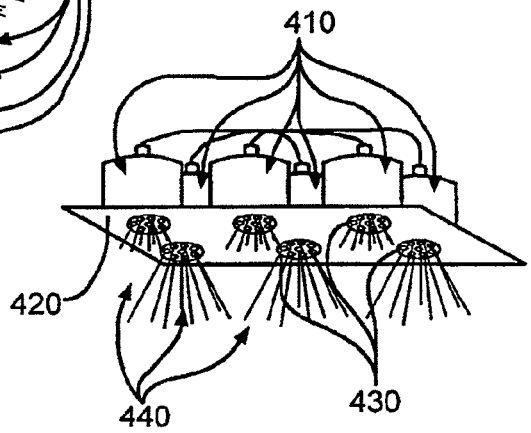
FIG. 7 is an illustration of a ceiling mounted fixture, comprised of multiple recessed gas generator units, according to yet another alternative embodiment of the invention

FIG. 7 is an illustration of a ceiling mounted fixture, comprised of multiple recessed gas generator units. This unit is virtually identical to the system disclosed in FIG. 6, except this variant exploits the presence of a drop ceiling common to many business and computer rooms, or any other ceiling configuration that permits the mounting of the gas generator units 410 above the ceiling level. The units 410 are mounted to a ceiling cover 420 that is flush with the ceiling, with exhaust holes 430 present in the cover 420 to permit the diffusion and discharge of the inert gas 440 from the gas generator units 410. This configuration has the advantage of having a flush-mounted ceiling unit, without any extension below the ceiling, in an even more discreet design.

Such "in-room" gas generator fire protection systems, with their local detection, power (if supplied with back up power from capacitors or small batteries) and discharge capabilities all present within the compartment, provide a robust protection system that is not impeded by power loss or loss of water pressure, or physical destruction of buildings or structures, or water mains (which would also render water sprinklers unusable) in the event of a catastrophic event at the facility in question, due to earthquakes or other natural disasters, explosions such as due to leaking gas mains, or even terrorist incidents, to continue to provide protection to critical compartments even if the rest of the facility is severely compromised.

An illustration of a particular swing example will demonstrate the features of the configurations set forth in the alternative embodiments of FIGS. 4-7.

EXAMPLE

An oxygen concentration of 13.5% is a desirable target level, to successfully extinguish fires with a sufficient 20% factor of safety as required by regulatory agencies such as the National Fire Protection Association, while maintaining sufficient oxygen levels for occupants for limited evacuation periods. Prior testing of prototype gas generator units has shown successful fire extinguishment with units sized approximately 20 gallons in volume, producing 0.53 5 kg-moles of nitrogen inert gas, discharged into a 1300 cubic foot room, an equivalent volume to be protected by one standard canister of traditional compressed stored inert gas. Such a unit was not optimized in size in any respect, with copious and un-optimized quantities of cooling bed materials used to cool the discharged nitrogen gas.

If such an un-optimized unit were prorated in size, including its oversized cooling bed capacity, it can provide a vastly conservative estimate of sizing on individual units and cartridges necessary when considering current art in gas generator technology and performance. The 0.535 kg-moles of gas can be increased to 0.6884 kg-moles to add the 20% factor of safety required, to result in a 13.5% oxygen concentration, which is still acceptable for occupants. Sizing for protection for only 100 cubic feet of room space, a total of 1.483 kg of nitrogen is needed, rounded up to 1.5 kg. Using the effective density of the tested unit, even with the un-optimized cooling bed, disc-shaped units of 24 inch diameter, and 1.5 inches thick, or rectangular units 4 inches thick by 9 inches wide and 18 inches long, can produce such quantities. Either unit variant is calculated to weigh 23.4 lbs., if scaling the previously tested 240 lb. unit. Numerous disc shaped units can be stacked for the floor or wall-mounted model; to protect the 1300 cubic feet space associated with a standard compressed inert gas canister, a unit 24 inches in diameter and 19.5 inches tall would be necessary (taking very little space in the room). Such a unit could be increased in room capacity if needed by making it wider or taller (theoretically up to the ceiling height), but it may be alternatively preferred to add additional floor units in a large room For the ceiling mounted units, the aforementioned rectangular gas generator units could be employed. This would result in an extended fixture distance below the ceiling of the unit of just over 4 inches. The units that recess into the ceiling could be of approximately 10 inches in diameter and 8 inches tall. These individual units can be seen to be of a weight practical for an individual installation technician to lift and install into the overhead ceiling fixture. If such fixtures are designed to hold up to eight gas generator cartridges per fixture, to protect a ten by ten floor space if an eight foot ceiling is present, then even the total maximum fixture weight of 187 lbs. is practical for mounting to ceiling joists (and less than some ornate lighting fixtures). The individual gas generator units would be designed to discharge their gas along opposite sides along their length through multiple orifices, with such a configuration canceling any thrust loads otherwise possible. Such eight-unit fixtures would only take the ceiling space of about three foot by three foot, including space between the gas generator units for gas to discharge and flow, which is roughly equivalent in area to two common ceiling tiles. The oxygen concentration will only fluctuate in an 800 cubic foot space of less than 1% as one adjusts and adds each additional discrete gas generator unit to adjust for extra room capacity, which is certainly an acceptable tolerance level. In addition, one or two of the additional individual gas generator units can be used under the subfloor of common computer rooms, to provide required fire protection in those spaces as well. Having a standard size for the cartridges works in favor of reducing the cost in gas generator production, by making many units of one size. If gas generator propellants and units continue to be optimized in the future, individual units as small as 4 inches by 2.5 inches by 5 inches, and a weight of 3.3 lbs. are possible, and full eight-unit ceiling fixtures could fit within a 12 inch square with a four inch thickness, and a weight of 26.5 lbs. fully loaded, if unit efficiencies near 100% are approached.

There is thus described novel techniques and features to improve the performance of fire extinguishing systems for occupied spaces employing solid propellant gas generators, which meets all of the objectives set forth herein and which overcomes the disadvantages of existing techniques.

The many features and advantages of the invention are apparent from the detailed specification and, thus, it is intended by the appended claims to cover all such features and advantages of the invention that fall within the true spirit and scope of the invention. Further since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method of suppressing fires in a space comprising the steps of:

generating a first oxygen displacing fire suppressing gas mixture from at least one non-azide solid propellant chemical, the first fire suppressing gas mixture comprising at least a first gas, said first gas comprising nitrogen;

delivering at least said first gas into the space thereby delivering a clean agent fire suppressant into said space to reduce the concentration of oxygen in said space to below a level necessary for sustaining combustion; and filtering at least a percentage of a second gas from the first fire suppressing gas mixture upon delivery into the space.

2. The method as claimed in claim 1, wherein the second gas comprises water vapor.

3. The method as claimed in claim 1, wherein the second gas comprises CO2.

4. The method as claimed in claim 1, wherein substantially all of the second gas is filtered from the first fire suppressing gas mixture.

5. The method as claimed in claim 1, further comprising the step of reducing the temperature of the second fire suppressing gas mixture.

6. The method as claimed in claim 1, wherein the clean agent fire suppressant is configured to leave no residue upon evaporation.

7. An apparatus for suppressing fires in a space comprising:

a generator for generating a first oxygen displacing fire suppressing gas mixture from at least one non-azide solid propellant chemical, the first fire suppressing gas mixture comprising at least a first gas, said first gas comprising nitrogen;

a diffuser for delivering at least said first gas into the space thereby delivering a clean agent fire suppressant to reduce the concentration of oxygen in said space for suppressing fires; and a filter for filtering at least a percentage of a second gas from the first fire suppressing gas mixture upon delivery into the space.

8. The apparatus as claimed in claim 7 wherein the second gas comprises water vapor.

9. The apparatus as claimed in claim 8 wherein the second gas comprises CO2.

10. The apparatus as claimed in claim 7 wherein the filter filters substantially all of the second gas from the first fire suppressing gas mixture.

11. The apparatus as claimed in claim 7 further comprising a screen reducing the temperature of the second fire suppressing gas mixture.

12. The apparatus as claimed in claim 7, wherein the clean agent fire suppressant is configured to leave no residue upon evaporation.

13. A system for suppressing fires in a space comprising:

a plurality of apparatus at respective locations within the space, each apparatus comprising:

a generator for generating a first oxygen displacing fire suppressing gas mixture from at least one non-azide solid propellant chemical, the first fire suppressing gas mixture comprising at least a first gas, said first gas comprising nitrogen; and a diffuser for delivering at least said first gas into the space thereby delivering a clean agent fire suppressant into said space;

wherein the volume of clean agent fire suppressant delivered by the plurality of apparatus reduces the concentration of oxygen in said space to below a level necessary to sustain combustion.

14. The system of claim 13, wherein each apparatus comprises a tower for housing one or more generators.

15. The system of claim 13, wherein each apparatus comprises a pyrotechnic device for igniting its respective solid propellant chemical.

16. The system of claim 15, further comprising:

a control panel connected to each pyrotechnic device for igniting the pyrotechnic device.

17. The system of claim 16, further comprising:

a sensor for detecting a fire and in response issuing a signal to the control panel for initiating the igniting of each pyrotechnic device.

18. The system of claim 16, further comprising:

a manual pull station for issuing a signal to the control panel for initiating the igniting of each pyrotechnic device.

19. An apparatus for suppressing fires in a space, comprising:

a generator for generating an oxygen displacing fire suppressing gas mixture from at least one non-azide solid propellant chemical, the oxygen displacing fire suppressing gas mixture having a first gas;

a filter for filtering out at least a portion of a second gas from the contents of the fire suppressing gas mixture thereby to result in a clean agent fire extinguishant; and a diffuser for delivering the clean agent fire extinguishant into the space to reduce the concentration of oxygen in said space for suppressing fires.

* * * * *